US009035566B2

(12) United States Patent
Du et al.

(10) Patent No.: US 9,035,566 B2
(45) Date of Patent: May 19, 2015

(54) LIGHT EMITTING DIODE DRIVER SYSTEMS AND ASSOCIATED METHODS OF CONTROL

(75) Inventors: Lei Du, Hangzhou (CN); Bairen Liu, Hangzhou (CN); Kaiwei Yao, San Jose, CA (US); Junming Zhang, Hangzhou (CN); Yuancheng Ren, Hangzhou (CN)

(73) Assignee: Monolithic Power Systems, Inc., San Jose, CA (US)

( * ) Notice: Subject to any disclaimer, the term of this patent is extended or adjusted under 35 U.S.C. 154(b) by 1088 days.

(21) Appl. No.: 13/048,699

(22) Filed: Mar. 15, 2011

(65) Prior Publication Data

US 2011/0227493 A1 Sep. 22, 2011

(30) Foreign Application Priority Data

Mar. 16, 2010 (CN) ..... 2010 1 0124502

(51) Int. Cl.
*H05B 37/02* (2006.01)
*H05B 33/08* (2006.01)

(52) U.S. Cl.
CPC ..... *H05B 33/0818* (2013.01); *H05B 33/0848* (2013.01)

(58) Field of Classification Search
CPC ..... H05B 37/02; H05B 33/08; H05B 41/16; H05B 41/36; H02M 3/335; H02M 3/33507; H02M 3/33515; G05F 1/46
USPC ..... 315/185 R, 209 R, 224–226, 291, 307, 315/308, 312
See application file for complete search history.

(56) References Cited

U.S. PATENT DOCUMENTS 8,054,008 B2 * 11/2011 Kimura ..... 315/307
2011/0068700 A1 * 3/2011 Fan ..... 315/185 R

* cited by examiner

*Primary Examiner* — Jimmy Vu
(74) *Attorney, Agent, or Firm* — Perkins Coie LLP

(57) ABSTRACT

Light emitting diode (LED) dimming and driver systems and associated methods of control are disclosed herein. In one embodiment, a system comprises a PFC stage and an LED driver stage. The LED driver stage comprises an isolated converter and a controller responsive to a dimming signal to dim LED strings for backlight. The controller also regulates an output current of the isolated converter.

13 Claims, 7 Drawing Sheets

LIGHT EMITTING DIODE DRIVER SYSTEMS AND ASSOCIATED METHODS OF CONTROL

CROSS-REFERENCE TO RELATED APPLICATION(S)

This application claims the benefit of Chinese Patent Application No. 201010124502.7, filed Mar. 16, 2010, the disclosure of which is incorporated herein by reference in its entirety.

TECHNICAL FIELD

The present technology generally relates to power supplies to light emitting diodes ("LEDs"), and more particularly, relates to LED power supply control and LED dimming control.

BACKGROUND

White LED strings are widely used as backlight of liquid crystal displays ("LCDs") in computers, televisions, and other electronic devices. Currently LED backlight power supplies typically use a three-stage driver system. As shown in FIG. 1, the driver system comprises a power factor correction ("PFC") stage 11, an isolated DC-DC (direct current to direct current) voltage converter stage 12, and an LED step-up driver stage 13. The PFC stage rectifies 220V or 110V AC (alternating current) voltage to about 400V or 200V DC (direct current) line voltage. The isolated DC-DC converter stage 12 comprises an isolated voltage converter to convert the DC line voltage to another DC voltage, for example, 120V, and thus provides an input voltage to the LED step-up driver stage 13.

The LED step-up driver stage 13 comprises one or more non-isolated boost converters to receive the output voltage/voltages from the isolated DC-DC voltage converter stage 12. Via the boost converter, a constant current is supplied to an LED string 14. The isolated DC-DC voltage converter stage 12 further transforms the line voltage to a lower DC voltage, for example 18V, which is further converted by system power converters 15 to multi-rail output DC voltages such as 12V and 5V for the system power supply of the controller devices.

The conventional LED driver system in FIG. 1 comprises multiple converters such as isolated converters, non-isolated converters, and system power converters 15. Each of these converters require a controller for control. Accordingly, the conventional LED driver system is complex, has a large size and high power consumption.

DETAILED DESCRIPTION

Various embodiments of switching regulators, circuits, and methods of control are described below. Many of the details, dimensions, angles, shapes, and other features shown in the figures are merely illustrative of particular embodiments of the technology. A person skilled in the relevant art will also understand that the technology may have additional embodiments, and that the technology may be practiced without several of the details of the embodiments described below with reference to FIGS. 2-7.

Certain embodiments of the present technology are directed to a two-stage LED driver system that comprises a power factor correction stage and an isolated voltage converter driver stage. The isolated voltage converter driver stage comprises an isolated voltage converter and a controller. The isolated voltage converter provides electrical power to the LED strings. The controller is responsive to the external dimming signal and operable to dim the LED strings so that a constant output current of the isolated voltage converter may be maintained.

In one embodiment, the isolated voltage converter is a fly-back voltage converter, and the controller is positioned at the secondary side of the isolated voltage converters. The primary side of the isolated voltage converter may include a current limit circuit to restrict the peak current flowing through the primary side winding. The current limit circuit comprises a resistor and a bipolar junction transistor ("BJT"). One end of the resistor is coupled to the output end of the primary side switch while the other end is coupled to the ground end of the primary side. The base of the BJT is coupled to the output end of the primary side switch. The collector of the BJT is coupled to the gate electrode of the primary side switch, and the emitter is coupled to the ground end of the primary side through another resistor.

Figure 1:
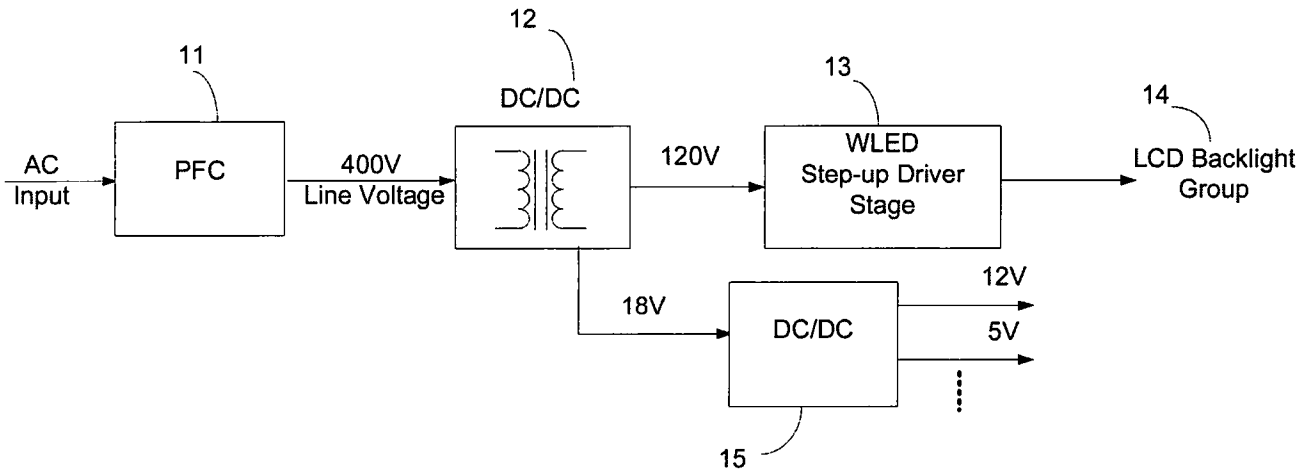
FIG. 1 (Prior Art)
FIG. 1 illustrates a prior art three-stage LED backlight driver system.
Figure 2:
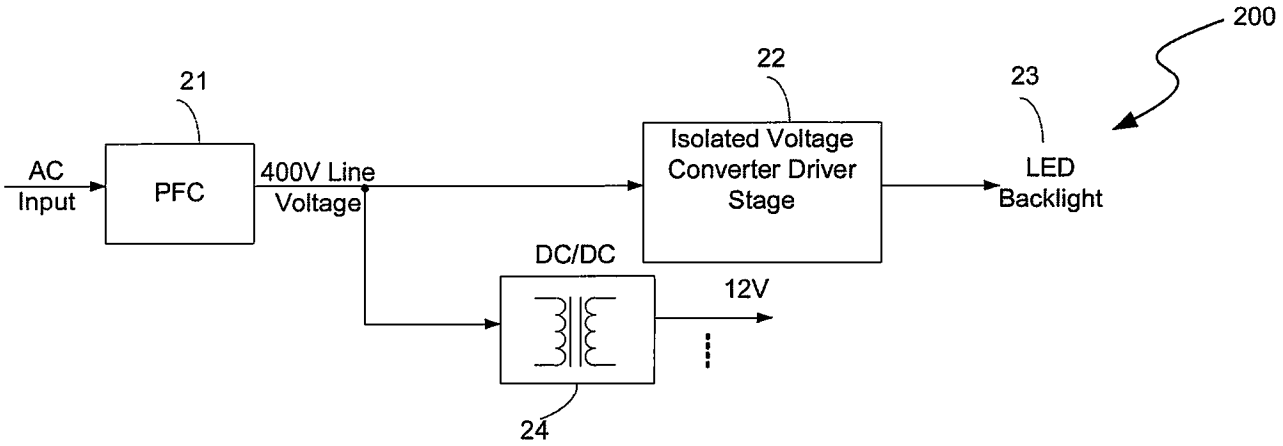
FIG. 2 is a schematic block diagram of a two-stage LED driver system according to one embodiment of the present technology.

FIG. 2 is a schematic block diagram of a two-stage LED driver system 200 according to one embodiment of the present technology. As seen in FIG. 2, the two-stage driver system 200 is applied to drive an LED backlight 23 of the LCD panel. The two-stage driver system 200 comprises a PFC stage 21 and an isolated voltage converter driver stage 22 for driving the LED backlight 23. The two-stage driver system 200 may further comprise at least one LED string as the LED backlight 23.

The PFC stage 21 has an input and an output, and the PFC stage 21 rectifies the AC (alternating current) voltage at the input to DC (direct current) line voltage at the output. For example, the PFC stage 21 converts an AC main voltage of 220V (or 110V) to a DC line voltage of approximate 400V (or 200V). The isolated voltage converter driver stage 22 has an input coupled to the output of the PFC stage 21.

The isolated voltage converter driver stage 22 converts the line voltage into another DC voltage. In one embodiment, the isolated voltage converter driver stage 22 comprises a plurality of isolated voltage converters, each driving one LED string. Thus the isolated voltage converter driver stage 22 may comprise a plurality of outputs. In other embodiments, the isolated voltage converter driver stage 22 may comprise a single or a group of isolated voltage converters to drive the LED strings.

The LED backlight 23 includes one or more LED strings, wherein each LED string comprises one or more LED diodes connected in series. An output of the isolated voltage converter driver stage 22 is directly coupled to the LED string to provide power to the LED string. The term "directly coupled" generally refers to the electric contact through conductive material such as through metal wire. The isolated voltage converter driver stage 22 also comprises one or more controllers for controlling the multiple isolated voltage converters.

Moreover, the two-stage driver system 200 further comprises system power supply converters 24 to transform the line voltage into several lower DC voltages, providing operational power for the isolated voltage converter driver stage 22. The system power converter 24 may be an isolated voltage converter or other suitable types of converter.

Figure 3:
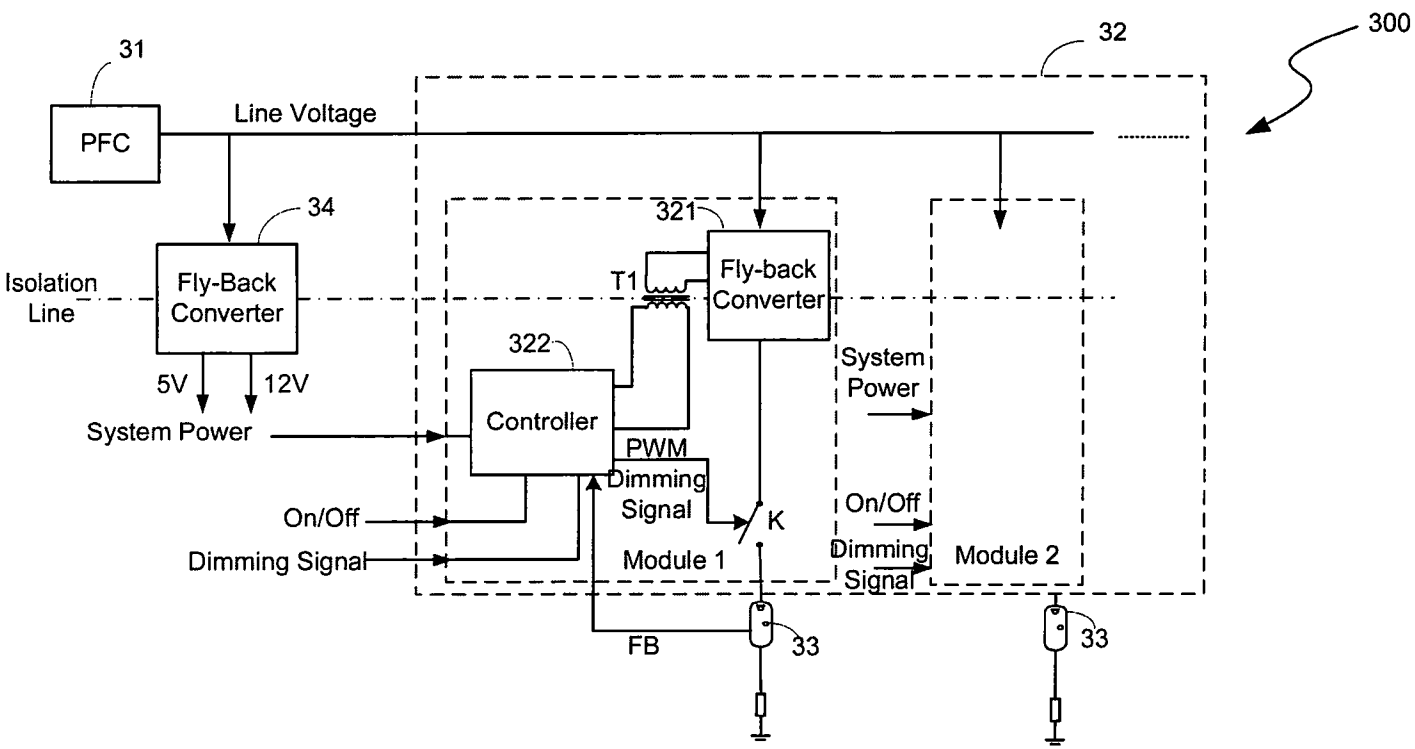
FIG. 3 is a schematic block diagram of a dimming and driver system according to one embodiment of the present technology.

FIG. 3 illustrates a two-stage driver system 300 according to one embodiment of the present technology. The two-stage driver system 300 comprises a PFC stage 31 and an isolated voltage converter driver stage 32. In one embodiment, the two-stage driver system 300 further comprises a plurality of LED strings 331 and 332 as shown in FIG. 3. The isolated voltage converter driver stage 32 comprises a plurality of isolated voltage converter modules including, for example, Module 1 and Module 2. Each of Module 1 or Module 2 has an input and an output. The input of each module is coupled to the output of the PFC stage 31, and the output of each module is coupled to an LED string 33 for power supplying the LED string 331 or 332.

Each of Module 1 or Module 2 comprises an isolated voltage converter and a controller. Each module may further comprise a dimming switch K coupled in series with the corresponding LED string. Module 1 is described in detail below. Module 2 and other modules (not shown) may have a similar configuration to Module 1, and thus are not described below for clarity.

Module 1 comprises an isolated voltage converter 321 and a controller 322. In one embodiment, Module 1 further comprises a dimming switch coupled in series with the LED string 331. As shown in FIG. 3, the isolated voltage converter 321 is a fly-back voltage converter. The controller 322 is coupled to the isolated voltage converter 321 and provides a control signal to the primary side switch of the isolated voltage converter 321 for regulating the output voltage of the isolated voltage converter 321. In other embodiments, the isolated voltage converter 321 can be a DC-DC fly-back converter, an AC-DC fly-back converter, and/or other suitable types of converter.

Receiving external dimming signals, the controller 322 further is coupled to the LED string 33 to provide a dimming signal for dimming the LED string 33. The isolated voltage converter driver stage 32 has a primary side and a secondary side as indicated by the isolation line illustrated in dash-and-dot line. Above the isolation line is the primary side while below the isolation line is the secondary side.

In the embodiment as shown, the controller 322 is positioned at the secondary side of the isolated voltage converter 321. As a result, the controller 322 delivers the control signals to the primary side of the isolated voltage converter 321 through an isolated transformer T1. In other embodiments, the controller 322 may transport the control signals across the isolation line through an optical coupler.

The two-stage driver system 300 may further comprise a system power converter 34. The system power converter 34 supplies power (for example, delivers 12VDC and 5VDC in FIG. 3) to the controller 322. A fly-back voltage converter is applied as the system power converter 34 in the shown embodiment. Other external control signals such as the on/off signal may be inputted into the controller 322 for controlling the operation of the two-stage driver system 300.

In one embodiment, the two-stage driver system 300 may have only one module, and thus only one isolated voltage converter 321 and one controller 322 is included to drive one LED string. In other embodiments, the two-stage driver system 300 may have other desired number of modules and corresponding number of isolated voltage converters and controllers.

Figure 4:
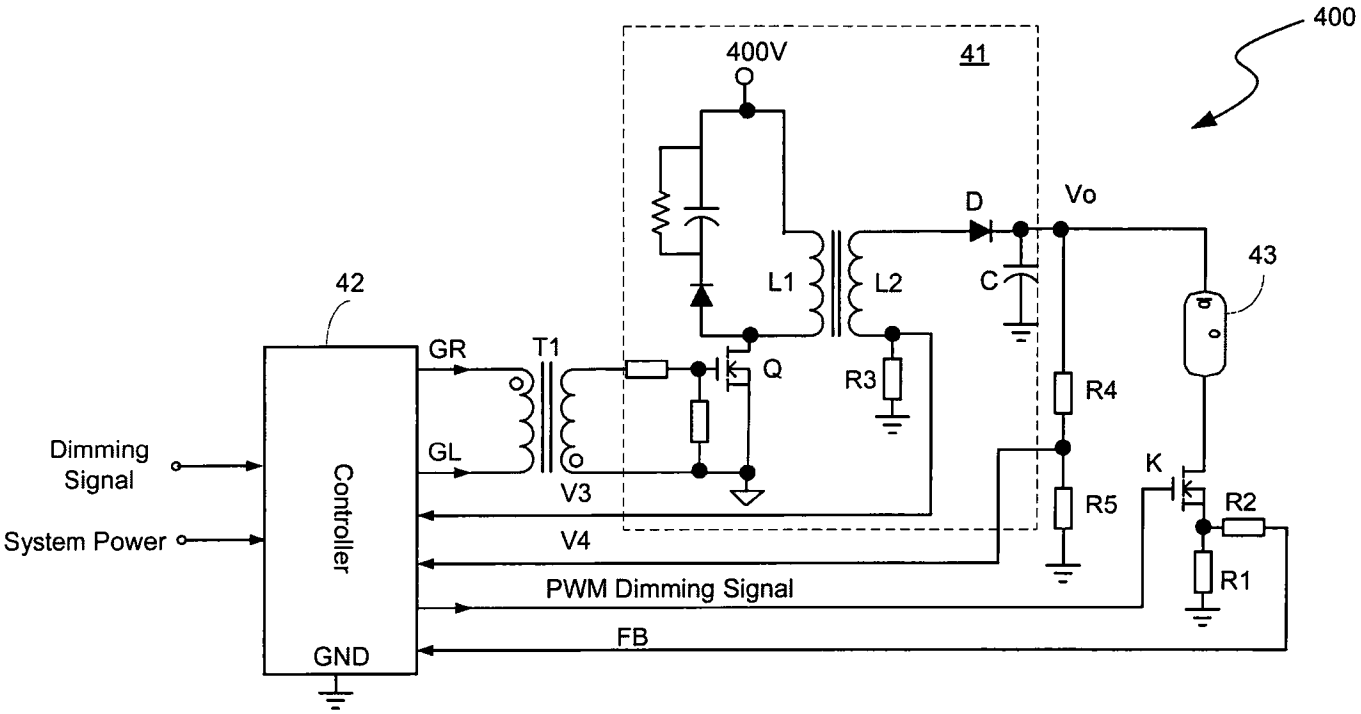
FIG. 4 illustrates a module of an isolated voltage converter driver stage in accordance with an embodiment of the present technology.

FIG. 4 depicts an isolated voltage converter module 400 according to one embodiment of the present technology. The isolated voltage converter module 400 comprises a fly-back voltage converter 41, a controller 42, a dimming switch K, and a transformer T1. In one embodiment, the isolated voltage converter module may comprise an LED string 43. In other embodiments, the LED string 43 may be omitted.

The primary side of the fly-back voltage converter 41 comprises a primary side winding L1 and a primary side switch Q. The output power of the fly-back voltage converter 41 is regulated by varying the operational duty cycle of the primary side switch Q. In the illustrated embodiment, the primary side switch Q is a MOSFET device. In other embodiments, the primary side switch Q can also be a junction field effect transistor and/or other suitable types of switching device.

The secondary side of the fly-back voltage converter 41 comprises a secondary winding L2, a rectifier D, and a filter capacity C. The LED string 43 is powered by the output of the fly-back voltage converter 41. The dimming switch K is connected in serial with the LED string 43 for dimming the brightness of the LED string 43. In the illustrated embodiment, the dimming switch K is a MOSFET. In other embodiments, the dimming switch K can also be a junction field effect transistor and/or other suitable types of switching device. The controller 42 is responsive to an external dimming signal and operable to generate a PWM dimming signal to control the gate of the switch K. As a result, by varying the duty cycle of the PWM dimming signal, the brightness of the LED string 43 is regulated.

The secondary side of the fly-back voltage converter 41 further comprises an LED current feedback circuit, which includes a current sense resistor R1 in the illustrated embodiment. One end of the resistor R1 is coupled to the source of the switch K. The other end of the resistor R1 is coupled to the ground of the secondary side.

The output feedback signal FB from the resistor R1 is provided to the controller 42. Specifically, in the illustrated embodiment, the feedback circuit transmits FB signals through another resistor R2. Voltage VFB as the FB signal reflects the current flowing through the LED string 43 when the dimming switch K is on, therefore VFB=ILED*R1. The controller 42 is responsive to the FB signal and accordingly operable to generate the PWM drive signal to the switch Q. As shown in FIG. 4, the controller 42 provides PWM drive signals GR and GL to a primary side circuit as a PWM signal via the transformer T1. The PWM signal, equaling or proportional to VGR-VGL, is provided to the gate of the primary side switch Q to regulate its duty cycle. Accordingly, the current of the LED string 43 may be kept constant. In other embodiments, the controller 42 may also provide the PWM drive signal to the primary side switch by optical coupler.

As shown in FIG. 4, the controller 42 may further comprise an over-current protection module configured to monitor a current flowing through the secondary side of the isolated voltage converter. When the current flowing through the secondary side of the isolated voltage converter is larger than an over-current reference threshold, the primary side switch of the isolated voltage converter is turned off.

In the illustrated embodiment, the over-current protection module comprises a resistor R3. The first end of the resistor R3 is coupled to the secondary side winding L2, and the other end of the resistor R3 is connected with the second side ground. Thus a voltage V3 across the resistor R3 is proportional to the secondary side current flowing through the secondary side winding L2. Voltage V3 corresponding to the resistor R3 is sent into the controller 42. When the secondary side current or V3 surpasses a reference threshold, the duty cycle of the PWM drive signal generated from the controller 42 falls to zero in order to turn off the primary side switch Q.

The controller 42 may further comprise a no-load protection module. The no-load protection module is responsive to the output voltage of the isolated voltage converter and selectively turns off the primary side switch when the output voltage is larger than an over-voltage reference threshold. Specifically, the voltage on the secondary side filter capacity C, in other words the output voltage Vout of the fly-back voltage converter 41, is sampled by a resistance divider of R4 and R5, thus producing voltage V4 to the controller 42. When the Vout rises over a reference value under no-load (the LED load is cut off) and/or other situations, the duty cycle of the PWM drive signal generated from the controller 42 falls to zero. Consequently the primary side switch Q is turned off.

Figure 5:
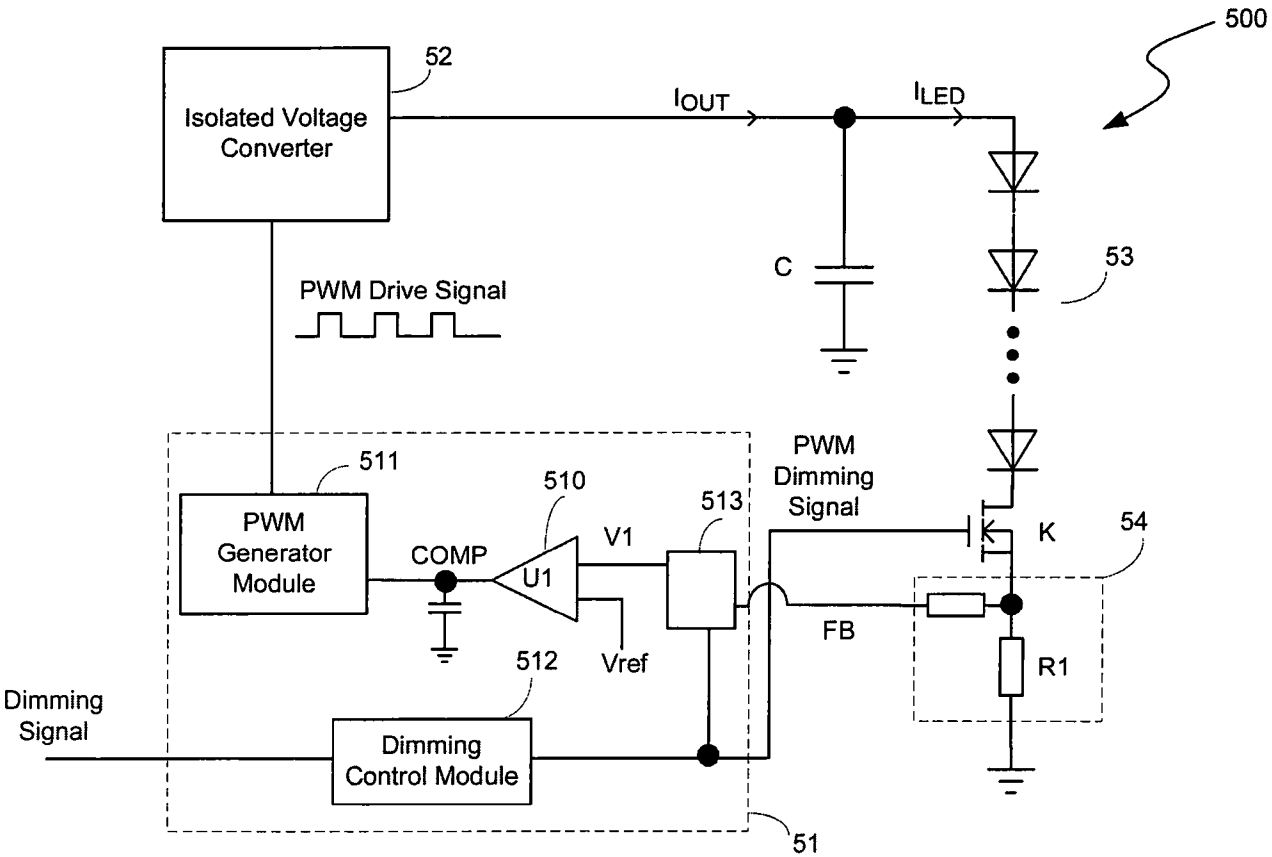
FIG. 5 illustrates a schematic block diagram of a controller according to one embodiment of the present technology.

FIG. 5 illustrates an isolated voltage converter module 500 according to one embodiment of the present technology. The isolated voltage converter module 500 comprises a controller 51, an isolated voltage converter 52, an LED string 53, a dimming switch K, and a feedback circuit 54. In one embodiment, the feedback circuit 54 comprises a part of the controller 51. The controller 51 controls the voltage regulation as well as LED dimming. In the illustrated embodiment, the controller 51 comprises a driver module and a dimming control module. The driver module comprises an error amplifier 510 and a PWM generator 511. The driver module is responsive to the current feedback signal of an LED string and operable to generate a PWM drive signal to the gate of the primary side switch in order to control its on and off function.

A dimming control module 512 is responsive to an external dimming signal and operable to generate a PWM dimming signal to the gate of the dimming switch K. Controlled by the PWM dimming signal, the brightness of the LED string is in proportion to its duty cycle. The external dimming signals provided to the controller 51 may be a PWM signal, a DC analog signal or a signal mixed with a DC analog signal, and a frequency signal. If the external dimming signal is a PWM signal, the dimming control module 512 generates a PWM dimming signal with the same wave form (consistent duty cycle and frequency). If the dimming signal is a DC analog signal, in one embodiment, the dimming control module 512 includes a triangular wave generator and comparator. The DC analog signal is compared with an internal triangular wave to generate the PWM dimming signal, of which the duty cycle is in proportion to the amplitude of the DC analog signal while the frequency is identical with the triangular wave. If the dimming signal is a signal mixed with a DC analog signal and a frequency signal, the dimming control module 512 generates a PWM dimming signal, the duty cycle of which is equal to the amplitude of the DC analog signal and the frequency of which is identical with the frequency signal.

The current $I_{LED}$ flowing through the LED string 53 is sensed by the feedback circuit 54 comprising a sampling resistor R1. The sampling resistor R1 has a first end and a second end. The first end is coupled to the dimming switch K, and the second end is connected to secondary side ground. Therefore, a current feedback signal FB is generated, which is the sensed voltage between the first end and the second end of the sampling resistor R1, i.e., $V_{FB}=I_{LED}*R1$. The error amplifier 510 compares the feedback voltage $V_{FB}$ with a reference voltage Vref, and hence provides an error signal COMP.

The controller may further comprise a hold-on module 513 to generate voltage V1. The first and second inputs of the module 513 are coupled to the feedback circuit 54 and the output of the dimming control module 512, respectively. The output end of the module 513 is coupled to the first input end of the error amplifier 510. The error amplifier 510 is responsive to the current feedback signal from the feedback circuit 54 and the voltage V1 and is operable to produce an amplified error signal COMP by amplifying the difference between the voltage V1 and the reference voltage Vref.

The PWM generator 511 is responsive to the COMP signal and operable to generate a PWM drive signal coupled to the gate of the primary side switch. In certain embodiments, the COMP signal is compared with a constant frequency triangular wave produced inside the PWM generator to generate the PWM signal. A trigger method such as double edge trigger, rising edge trigger, or falling edge trigger may be applied. Driven by the PWM drive signal, the primary side switch functions such that the isolated voltage converter 52 provides a constant current $I_{OUT}$ in order to light the LED string 53.

Figure 6:
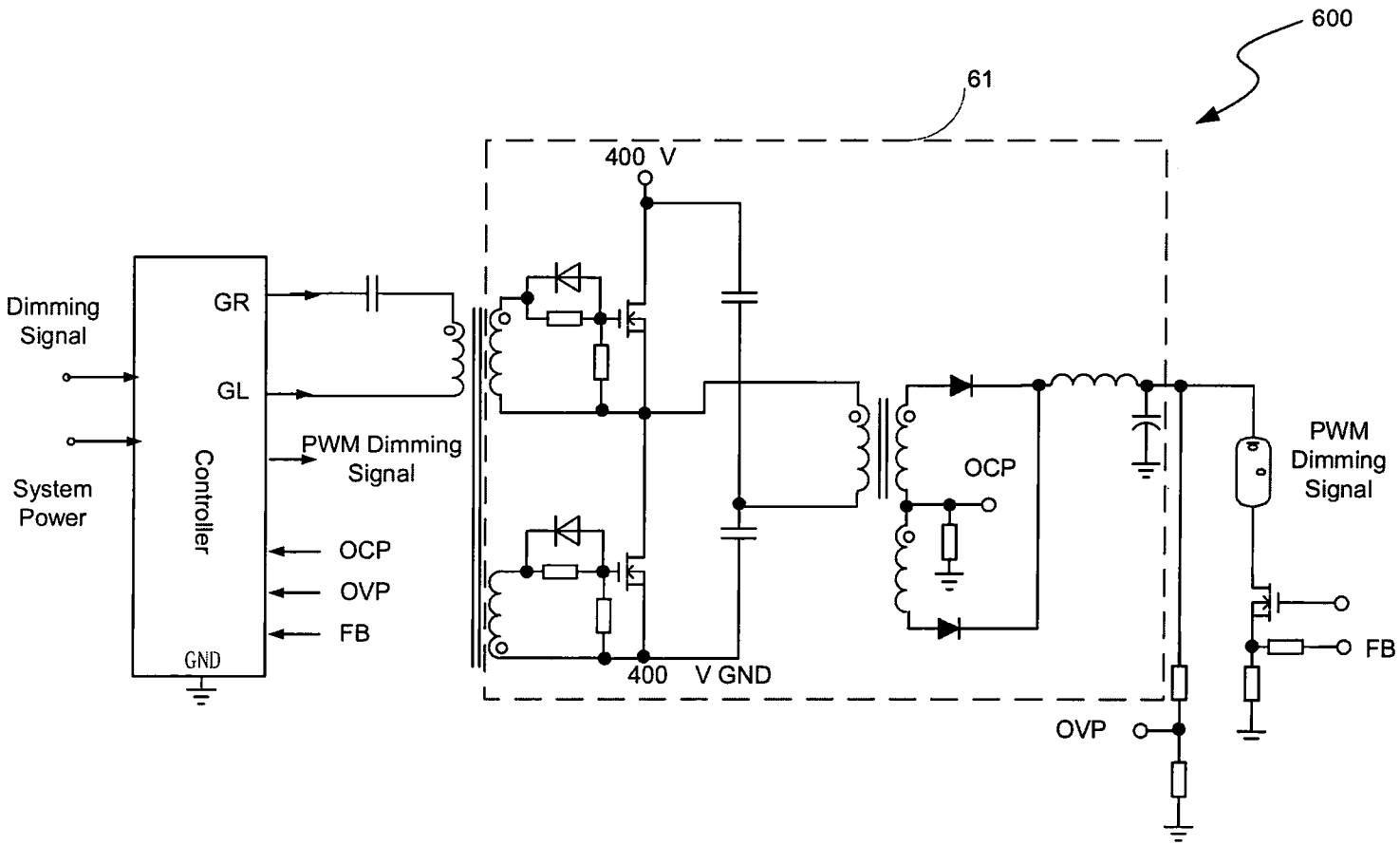
FIG. 6 illustrates an embodiment of the present technology incorporating an isolated half-bridge voltage converter.

Despite the fact that the isolated voltage converter shown in FIG. 3 is a fly-back voltage converter, other topologies can also be applied for the isolated voltage converter, such as forward, half-bridge, full-bridge, or other types of topological structure. As shown in FIG. 6, a half-bridge voltage converter 61 is used in the dimming and driver system.

The controller described above is positioned at the secondary side of the isolated voltage converter, so there is no peak current control as in a conventional primary side circuit. In certain embodiments, a current limit circuit may further be included in the controller to prevent the transformer from reaching saturation states.

Figure 7:
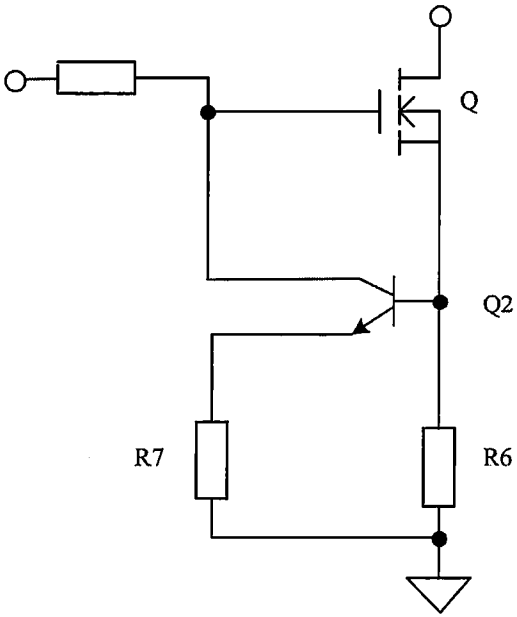
FIG. 7 illustrates a current limit circuit according to one embodiment the present technology.

FIG. 7 illustrates an embodiment of a current limit circuit positioned at the primary side. In the illustrated embodiment, the current limit circuit is a closed-loop circuit comprising a transistor Q2, a resistor R6 and a resistor R7. The first end of the resistor R6 is connected to the source of the primary side switch Q and the second end of the resistor R6 is connected to the primary side ground. The transistor Q2 has a base, an emitter, and a collector. The base of the transistor Q2 is connected to the source of switch Q; the collector of the transistor Q2 is connected to the gate of switch Q; and the emitter of the transistor Q2 is connected to the ground via another resistor R7. If the primary side current is too high, the base voltage increases to turn the transistor Q2 on and the gate voltage of the transistor Q is pulled down. Consequently, the primary side current falls off. The closed-loop circuit clamps the primary side current in an appropriate range, which is determined by the parameter of the switch Q, the transistor Q2, the resistor R6, and the resistor R7 so that over-current protection is achieved.

From the foregoing, it will be appreciated that specific embodiments of the technology have been described herein for purposes of illustration, but that various modifications may be made without deviating from the disclosed technology. Elements of one embodiment may be combined with other embodiments in addition to or in lieu of the elements of the other embodiments. Accordingly, the technology is not limited except as by the appended claims.

We claim:

1. A light-emitting diode (LED) driver system comprising:

a power factor correction stage having an input and an output;

an isolated voltage converter driver stage having an isolated voltage converter, wherein an input of the isolated voltage converter driver stage is coupled to the output of the power factor correction stage; and an LED string, comprising one or more LED diodes in series, wherein an output of the isolated voltage converter driver stage is directly coupled to the LED string to provide power to the LED string;

wherein the isolated voltage converter driver stage further comprises a controller and the isolated voltage converter comprises a primary side switch at a primary side of the isolated voltage converter driver stage, and wherein the controller is coupled to the primary side switch to provide a control signal for controlling the isolated voltage converter, and wherein the controller is further coupled to the LED string to provide a dimming signal for dimming the LED string.

2. The LED driver system according to claim 1, wherein the isolated voltage converter is a fly-back voltage converter.

3. The LED driver system according to claim 1, wherein the isolated voltage converter is a half-bridge or full-bridge voltage converter.

4. The LED driver system according to claim 1, further comprising a plurality of isolated voltage converters and a plurality of LED strings, and wherein each isolated voltage converter is connected in series with a corresponding LED string.

5. The LED driver system according to claim 1, further comprising a dimming switch connected in series with the LED string, and wherein the controller comprises:

a driver module, the driver module configured to be responsive to a current feedback signal from the LED string, and operable to generate a pulse width modulation (PWM) drive signal to control the primary side switch; and a dimming control module configured to be responsive to an external dimming signal and operable to generate a PWM dimming signal to control the dimming switch to regulate the brightness of the LED string.

6. The LED driver system according to claim 5, wherein the driver module comprises:

an error amplifier configured to be responsive to the current feedback signal and a reference value, and operable to generate an amplified error signal; and a PWM generator configured to be responsive to the amplified error signal and operable to generate and provide the PWM drive signal to the gate of the primary side switch.

7. The LED driver system according to claim 5, wherein the primary side switch and the dimming switch are MOSFET devices.

8. The LED driver system according to claim 5, further comprising a sampling resistor having a first end coupled to the dimming switch and a second end connected to a secondary side ground, wherein the current feedback signal is generated from a voltage developed between the first and second ends of the sampling resistor.

9. The LED driver system according to claim 1, wherein the controller further comprises an over-current protection module configured to monitor a current at the secondary side, and wherein the over-current protection module is configured to turn off the primary side switch when the current at the second side is larger than an over-current threshold.

10. The LED driver system according to claim 1, wherein the controller further comprises a no-load protection module configured to monitor an output voltage of the isolated voltage converter, and wherein the no-load protection module is configured to turn off the primary side switch when the output voltage is larger than an over-voltage reference threshold.

11. The LED driver system according to claim 1, wherein the controller is positioned at a secondary side of the isolated voltage converter driver stage.

12. The LED driver system according to claim 11, wherein the controller is coupled to the primary side switch through a transformer.

13. The LED driver system according to claim 1, comprising a current limit circuit coupled to the primary side to limit the current at the primary side, wherein the current limit circuit comprises:

a first resistor having a first end and a second end, wherein the first end is coupled to the primary side switch and the second end is coupled to a primary side ground;

a second resistor having a first end and a second end, wherein the first end is coupled to the primary side ground; and a transistor having a base, an emitter, and a collector, wherein the base is coupled to the primary side switch, the collector is coupled to the primary side switch, and the emitter is coupled to the second end of the second resistor.

* * * * *